United States Patent [19]

Morgan, IV

[11] Patent Number: 5,058,746

[45] **Date of Patent: * Oct. 22, 1991**

[54] PALLET CONTAINER STRUCTURE II

[76] Inventor: Robert L. Morgan, IV, 12450 E. 'O' Ave., Climax, Mich. 49034

[ * ] Notice: The portion of the term of this patent subsequent to Jul. 16, 2008 has been disclaimed.

[21] Appl. No.: 417,000

[22] Filed: Oct. 4, 1989

[51] Int. Cl.[5] ..... B65D 19/18

[52] U.S. Cl. ..... 206/597; 206/598; 220/4.32; 220/345

[58] Field of Search ..... 206/386, 596, 597, 600, 206/598; 220/4 F, 4 R, 345

[56] References Cited

U.S. PATENT DOCUMENTS

| | | | |
|---|---|---|---|
| 2,903,126 | 9/1959 | Heath | 206/597 |
| 3,527,373 | 9/1970 | Giraudet et al. | 220/345 |
| 3,809,278 | 5/1974 | Csumrik | 220/4 F |
| 4,221,302 | 9/1980 | Kupersmit | 220/4 F |
| 4,244,471 | 1/1981 | Plante | 206/386 X |
| 4,550,830 | 11/1985 | Shuert | 206/386 |
| 4,643,314 | 2/1987 | Kidd | 206/386 X |
| 4,673,087 | 6/1987 | Webb | 220/4 F X |
| 4,676,373 | 6/1987 | Schneider | 206/386 |

FOREIGN PATENT DOCUMENTS

| | | | |
|---|---|---|---|
| 611899 | 10/1960 | Italy . | |
| 2166116 | 4/1986 | United Kingdom | 220/4 F |

*Primary Examiner*—Paul T. Sewell
*Assistant Examiner*—Jacob K. Ackun, Jr.
*Attorney, Agent, or Firm*—Gordon W. Hueschen

[57] ABSTRACT

A knockdown pallet container formed of extruded pallet members, comprising a bottom-forming pallet member, a top pallet member, and side pallet members, a combination of the bottom, side, and top members providing a pallet container of preferably rectangular configuration, at least the bottom-forming member being honeycombed so as to provide entryways in the extruded member for insertion of the prongs of a lift truck thereinto, the rectangular pallet container being banded together by external strapping which holds dovetails at sides of the various members in mating engagement with each other where they meet to form corners of the container, is disclosed, as well as various internal support members having dovetails which interlock with complementary dovetails provided on interior surfaces of the various pallet members.

63 Claims, 3 Drawing Sheets

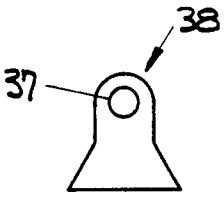
FIG. 7
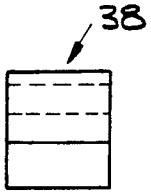
FIG. 8
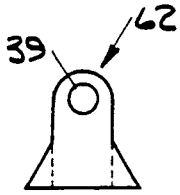
FIG. 9
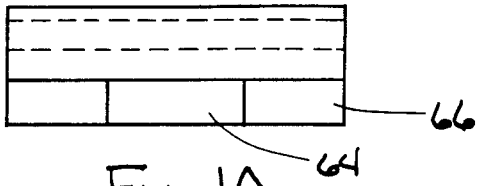
FIG. 10
FIG. 13
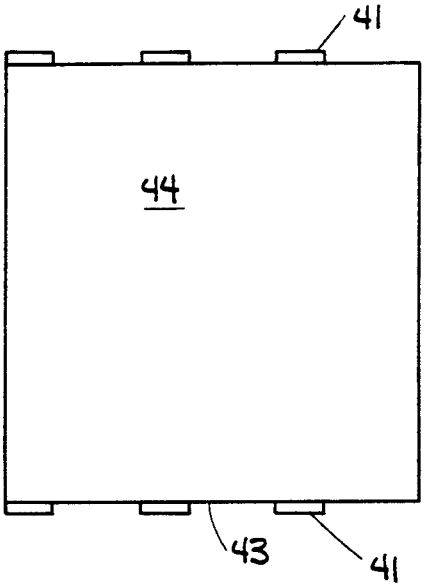
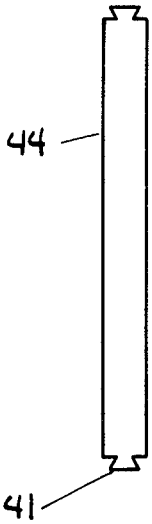
FIG. 14
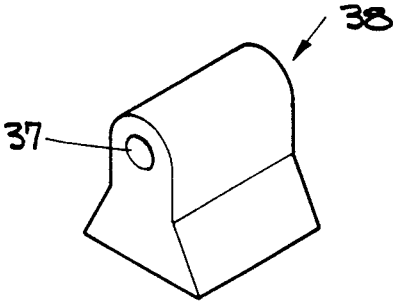
FIG. 11
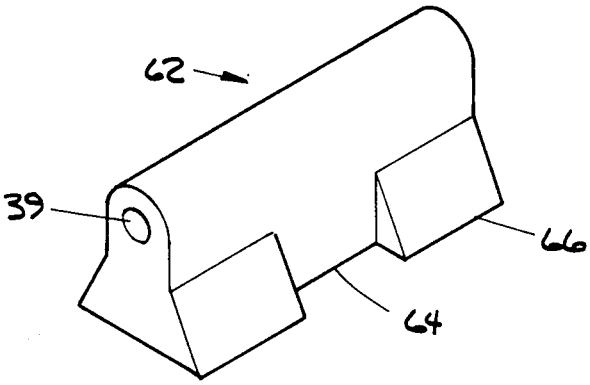
FIG. 12

PALLET CONTAINER STRUCTURE II

BACKGROUND OF THE INVENTION

1. Field of Invention

The field of the invention is shipping containers, more particularly, containers having a pallet feature combined therewith.

According to American National Standard "Pallet Definitions and Terminology", ANSI MH1.1.2-1978, published by The American Society of Mechanical Engineers, the pallet container (or container pallet) of the present invention may in some embodiments also be referred to as a "single deck pallet with truck openings", or as a "non-reversible flush deck with four way entry" pallet, or, when using load-conforming inserts, also as a "special purpose pallet" but, especially when four pallet members and two end members are employed to provide a six-sided shipping container, it is more precisely referred to according to the standard, as a "pallet container" or "container pallet".

2. Prior Art

Numerous pallets of innumerable types, sizes, and configurations have been known in the art. However, few are what can properly be referred to, according to the standard, as a "pallet container" or "container pallet", and none of the pallets known to be available in the prior art have the advantages and features of the pallet container of the present invention.

Searches conducted in USPTO Classes 206, Subclasses 316, 320, 386, 389, 453, 577, 592, 593, 600, and 621, and in Class 217, Subclasses 12R and 69, and in Class 220, Subclasses 1.5 and 4F, as well as in Class 108, Subclasses 51.1, 55.1, 55.3, 56.1, 56.3, and 901, turned up only a few patents on shipping pallets or containers which can properly be referred to as "pallet containers". These are as follows: U.S. Pat. No. 3,477,631 Dunlap et al., U.S. Pat. No. 4,614,277 Fourie et al., U.S. Pat. No. 3,776,435 Smith, and U.S. Pat. No. 3,828,965 Yarbrough. Related patents U.S. Pat. No. 4,730,732 to Wagonseller and U.S. Pat. No. 4,435,463 to Roellchen also had some relevance. However, none of these patents disclose a pallet with a design feature which allows the pallet to be transformed into a container, and Wagonseller and Roellchen disclose only roll and cylindrical object-supporting devices for use in supporting shaped articles, but not particularly for use in close compatibility with a shipping container, much less a pallet container. Moreover, none of the patents turned up in the search disclosed the type of pallet container provided according to the present invention or any of numerous significant advantageous features thereof.

THE INVENTION IN GENERAL

The present invention, as already stated, relates to shipping containers and more particularly to containers having a pallet feature combined therewith, which can be referred to according to the universal standard as a "pallet container". The invention, in certain embodiments, comprises a special design feature which makes it a four-way entry pallet with a non-reversible deck. The pallet design is such that four (4) pallets or panels may be used to construct a pallet container or container pallet. If desired, end plates, walls, or caps may be employed as an integral part of the container to form a six (6) sided container or box. The resulting container or box will, in such case, totally enclose and protect the contents thereof. The pallet container may, moreover, include product-conformable or other inserts attached to the pallet decks to further support and protect the contents of the pallet container. The pallet container of the invention may be fully or partially disassembled at the shipping destination and the components thereof returned to the place of origin, insofar as it is a knock-down (KD) type of pallet container. Alternatively, and advantageously, the pallet comprising the bottom member of the pallet container may continue to serve as a supporting pallet for the contents of the pallet container upon reaching the shipping destination, while one or more of the other three (3) sides of the container, along with the end caps if desired, may be returned to the place of origin, whether or not the bottom load-supporting pallet member is to follow back to the place of origin.

The pallet container of the invention may advantageously be structured to provide the ability for a four (4) way entry with fork trucks. Moreover, the units may conveniently be stacked for storage and transportation. A stacking aid with protusions which engage reinforcing ribs, protrusions, or irregularities of the pallet exteriors is sometimes useful, although not essential, for preventing load shifting during transport.

The pallet container of the invention may be produced from a wide variety of materials, e.g., extruded plastic, whether thermosetting, thermoplastic, or foamed and, if desired, filled with one or more usual fillers. The unit can also be produced from metals or other extruded material.

As extrusions, the pallet or panel members which, according to the invention, can be employed to produce a pallet container of the invention, may have either axis as major axis, each arrangement having some advantage. One axis can be chosen for the extruding machine direction when long pallets are desired for the shipment of long objects or when small profiles are required. The other direction may be selected as the major axis when objects of greater profile but minimum length are desired to be shipped.

The present invention, in any event, provides a superior and advantageous alternative to any of the presently-available pallets or pallet containers, especially those where a site-fabricated container and pallets or skids are employed for shipping.

FURTHER DETAILS OF THE INVENTION

The exterior surfaces of the pallet container of the invention may have a "waffled", ribbed, or irregular surface pattern to prevent slippage or load shifting during transport, and the interior surfaces are advantageously provided with mating devices or points which aid in locating and fixing the load-conforming or other inserts. Locking keys, dovetails, and fasteners may be employed to secure inserts within the pallet containers of the invention. Adhesive securement is also a preferred securement means. Attachment devices may also be molded into the pallet deck or provided in the form of inserts for securement of loads using conventional slings and binders. When end plates, walls, or caps are employed, suitable end closure means and retainers may be incorporated into the design, for example, the end plates, walls, or caps may be fitted into grooves provided in the walls of the pallet container, with suitable means being provided for the insertion and removal thereof, for example, a suitable slot in one of the wallforming pallet members, normally the top wall of the pallet container.

When manufactured as an extrusion of any type, having voids therein as is usual in the extrusion art, some of such voids may be filled with any suitable material, e.g., particulate filler or foam, for purposes of absorbing shock and providing additional strength to the structure.

Combinations of engineering materials may be employed in the manufacture of the pallet containers of the invention to yield a selected and desired weight and strength, as well as cosmetic properties.

The pallet containers of the invention are adapted to be banded over the exterior thereof at final assembly, that is, secured together by strapping of metal or plastic, such as steel or Signode Dymax TM strapping.

In some embodiments, the pallet container of the invention comprises yieldable inserts which are configured for support of an article intended to be contained therein, which inserts may also conveniently serve as separators between various articles being shipped in a single pallet container of the invention.

Among the uses uniquely characterizing the pallet containers of the present invention are the following:

When employing conformable inserts, for the shipment of any object or objects, whether symmetrical or not.

In the shipment of liquids, employing a bladder for the liquid and suitable internal supports when required. Such pallet container is KD for return shipment.

For parts shipment, any single or multiple of the parts unit may be shipped into the production area in a pallet container of the invention, which may be used for turnaround and the shipment of finished goods out of the production area in the same pallet container.

For air freight, in cases of urgency, with the KD unit components to be returned by surface transportation.

Using an air bladder insert as a conformable insert, for the shipment of delicate goods which might otherwise be damaged during shipment without such type of support.

Employing one or more stacking trays in the pallet container of the invention makes them particularly adaptable for the shipment of fresh produce and other bulk items which are sensitive to packing. Shipment can be by intermodal means and, once again, the KD components of the pallet container of the invention may be conveniently returned by surface means. This type of arrangement is especially suitable for fresh market produce, raisins, and the like.

OBJECTS OF THE INVENTION

It is an object of the present invention to provide an improved pallet container and the various components thereof which are necessary to complete its assembly in various forms or embodiments. A particularly preferred object is to provide such a knowdown (KD) pallet container which is extruded. It is a further object of the invention to avoid the disadvantages and shortcomings of the prior art in this area or field of pallet containers. It is another object of the invention to obtain such advantages over prior art pallet containers as are provided by the pallet containers of the present invention. Other objects of the invention will be apparent to one skilled in the art and still others will become obvious as the description proceeds.

SUMMARY OF THE INVENTION

The invention, then, inter alia, comprises the following, singly or in combination:

A knockdown pallet container formed of extruded pallet members, comprising a bottom-forming pallet member, a top pallet member, and side pallet members, a combination of the bottom, side, and top pallet members providing a pallet container of rectangular configuration, at least the bottom-forming pallet member being honeycombed so as to provide entryways in the extruded member for insertion of the prongs of a lift truck thereinto, the rectangular pallet container being adapted to be banded together when necessary or desirable by external strapping which holds complementary dovetail means at sides of the various pallet members in mating engagement with each other where they meet to form corners of said container; such a pallet container wherein the sides of the pallet members are configured so as to provide complementary male and female dovetail means; such a pallet container wherein the sides of the pallet members are configured so as to provide male and female interlocking dovetails; such a pallet container wherein at least the bottom-forming pallet member has entryways for the prongs of a lift truck at both its front and rear; such a pallet container wherein internal support means are provided for supporting a load interior of said pallet container; such a pallet container wherein the internal support means are provided with dovetail means adapted to mate with complementary dovetail means provided on pallet members interior of the pallet container; such a pallet container wherein the dovetail means comprise a male dovetail on the internal support means and a female dovetail on a surface of a pallet member interior of the container; such a pallet container comprising end wall or divider means; such a pallet container comprising also means for securing said end wall or divider means with respect to a pallet member of said container; such a pallet container wherein said securing means comprises a slot in a pallet member of said container adapted to receive said wall or divider means; such a pallet container comprising also a through-slot in a pallet member for insertion of said wall or divider means into said container through said member; such a pallet container wherein said pallet member comprising said through-slot is a top member; such a pallet container wherein said wall or divider means comprises finger-grip means to assist with insertion and removal thereof; such a pallet container comprising end walls at both the front and rear thereof; such a pallet container wherein said end walls are received in slots in three pallet members and inserted into said container via a through-slot provided in the remaining panel or pallet member; such a pallet container comprising also internal support means adapted to support or protect a load being transported therein; such a pallet container comprising contoured external surfaces adapted to cooperate with similar external surfaces of abutting pallet containers of the same type, thereby to prevent excessive relative movement between abutting pallet containers during transportation thereof; such a pallet container comprising entryways for the entry of forklift prongs also in one or more of the side and top pallet members, thereby to permit entry of prongs of a forklift whether the pallet container is resting upon one member or another; such a pallet container wherein entryways for the entry of prongs of a forklift are provided in all four of the bottom, top, and side pallet members, thereby to allow entry of prongs of a forklift regardless of the member upon which said pallet container is resting; such a pallet container comprising entryways for the insertion of prongs of a forklift therein in all of the pallet members at both their front and at their rear; such a pallet container wherein all of said pallet members are honeycombed and wherein said entryways are provided in the form of apertures into the pallet members themselves; such a pallet container comprising variable and removable interlocking internal support means for support or protection of a load being shipped; such a pallet container comprising internal engagement means on interior walls of the pallet members, adapted to receive complementary engagement means of tiedowns, dividers, shelves, trays, and the like; such a pallet container wherein interior walls of pallet members are provided with female dovetail elements and the interior support means is provided with male dovetail elements for mating engagement therewith; such a pallet container wherein said internal support means comprises tiedown means, wall-to-wall horizontal divider means, support means adapted to the shape of the load being shipped, or the like; such a pallet container wherein said internal support means comprises a bladder or airbag having filling means and wherein an adjacent wall of said container, comprises an aperture for said filling means whereby it is accessible from outside the container; such a p pallet container wherein the top and bottom pallet members have identical end dovetail means and the side panels have identical side dovetail means at their ends, the one means being male and the other means being female, thereby to provide a mating dovetail joint at the container corners; such a pallet container wherein the bottom, top, and side pallet members of the pallet container have identical dovetail means at the opposite ends thereof which abut at each corner of the container, so as to provide identical dovetail joints at the corners of the container; such a pallet container wherein there are only two types of dovetail means, which means are identical at both ends of the same pallet member; such a pallet container wherein the dovetail means is the same for all pallet members at both ends thereof; such a pallet container wherein the container is formed from a plurality of identical pallet sections; such a pallet container wherein mating dovetail elements are provided with notches in female and male members thereof, so as to permit ready insertion of one dovetail member into another and securement of the dovetail joint by sliding a male dovetail element to a position of mating engagement with walls of a female dovetail element; such a pallet container wherein interior walls of pallet members are provided with female dovetail elements and interior support means is provided with male dovetail elements for mating engagement therewith; such a pallet container wherein internal support members are provided with male dovetail elements and interior walls of pallets members are provided with female dovetail elements for mating engagement therewith; such a pallet container wherein said male and female dovetail elements are provided with notches for ready insertion of male dovetail elements into female elements and for slidable engagement into secured relationship therewith; and such a pallet container wherein at least one of the bottom, top, and side pallet members is formed from a plurality of identical sections.

Moreover, a knockdown pallet container formed of extruded pallet members, comprising a bottom-forming pallet member and side and/or top pallet members, a combination of the bottom, side, and/or top pallet members providing a pallet container of polygonal configuration, at least the bottom-forming pallet member being honeycombed so as to provide entryways in the extruded member for insertion of the prongs of a lift truck thereinto, the polygonal pallet container being adapted to be banded together when necessary or desirable by strapping which holds complementary dovetail means at sides of the various pallet or panel members in mating engagement with each other where they meet to form corners of said container; such a pallet container wherein the sides of the pallet members are configured so as to provide complementary male and female dovetail means; such a pallet container wherein the polygonal container has the configuration of a polygon having a maximum of four sides; such a pallet container wherein more than one pallet member is honeycombed and has entryways for the prongs of a lift truck at both ends thereof; such a pallet container wherein all of said pallet members are honeycombed and all have entryways for the prongs of a lift truck at both ends thereof; such a pallet container comprising at least one end wall or divider mounted in slots or recesses in a plurality of the said pallet members, and such a pallet container which is banded together by external strapping.

Moreover, a pallet member adapted to produce, with additional identical or similar pallet members, a rectangular pallet container, having dovetail means at the sides thereof adapted for mating engagement with complementary dovetail means at the sides of identical or similar pallet members to form a joint at the corners of a rectangular pallet container formed therefrom; as well as a pallet member adapted to produce, with additional identical or similar pallet members, a polygonal pallet container, having dovetail means at the sides thereof adapted for mating engagement with complementary dovetail means at the sides of identical or similar pallet members to form a joint at the corners of a polygonal pallet container formed therefrom; such a pallet member wherein the dovetail means at one side of the pallet member has a female dovetail configuration and the means at the other side of the pallet member has a male dovetail configuration; and such a pallet member wherein the dovetail means at both sides of the pallet member has the same dovetail configuration.

BRIEF DESCRIPTION OF THE DRAWINGS

The invention will be better understood by reference to the drawings, wherein:

FIG. 7 is a front or face view of a tiedown conveniently employed in a pallet container of the invention;

FIG. 8 is a side view of the structure of FIG. 7;

FIG. 9 is a front or face view of a longer tiedown which is conveniently employed in a pallet container of the invention;

FIG. 10 is a side view of the structure of FIG. 9;

FIG. 11 is an isometric view of the structure of FIGS. 7 and 8;

FIG. 12 is an isometric view of the structure of FIGS. 9 and 10;

FIG. 13 is a top plan or face view of a removable divider conveniently employed in a pallet container of the invention and as previously shown in FIG. 3; and FIG. 14 is an end view of the structure of FIG. 13.

DETAILED DESCRIPTION OF PREFERRED EMBODIMENTS OF THE INVENTION

Reference is now made to the accompanying drawings for a better understanding of the invention, in which all essential parts or elements are numbered and the same or similar numbers are employed to refer to the same or similar parts or elements throughout.

Figure 1:
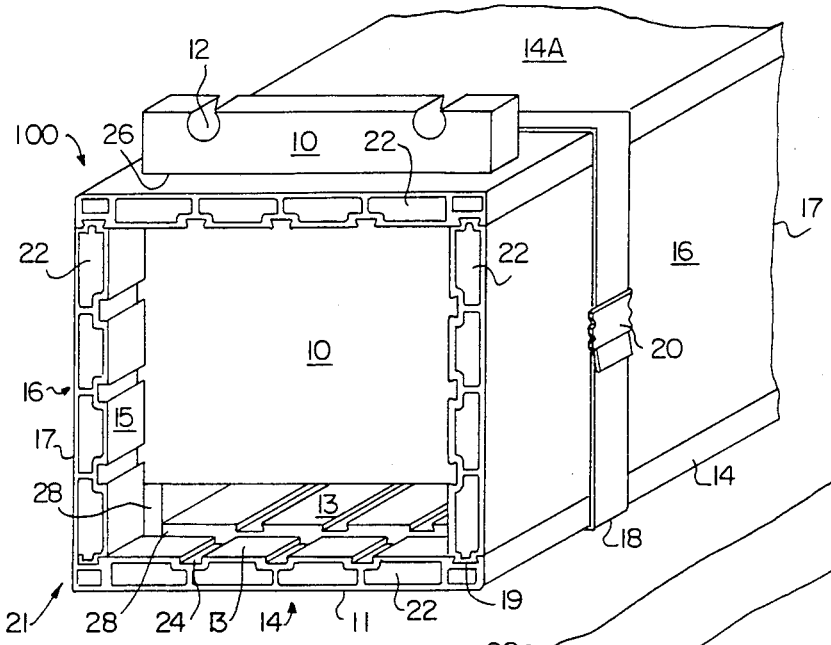
FIG. 1 is an isometric view of a pallet container of the invention viewed from one end, e.g., the front or rear with end plate, wall, or cap partially inserted therein.

Referring to FIG. 1, a fully-assembled pallet container of the invention is shown generally at 100. The pallet container comprises honeycombed extruded bottom pallet member 14, top pallet member 14A which is the same as bottom-forming pallet member 14 but with a through-slot 26 added for entry of wall or divider panel member 10, and side pallet members 16, left and right side pallet members being the same, both of which comprise receiving slot 28 for wall or divider panel member 10 which cooperates with receiving slot 26 in bottom pallet member 14 for seating of wall or divider panel 10. Panel member 10 comprises fingergrip means in the form of apertures or slots 12 for insertion of fingers to assist with insertion and removal of end or divider panel member 10 when desired. Bottom pallet member 14, top pallet member 14A, and side pallet members 16 are all connected together at the junctures of their side edges by means of male dovetail means or element 19 and complementary female dovetail means or element 24, together comprising the completed dovetail juncture, assembly, or joint as shown at 21. This assembly, as will be readily observed, is the manner in which the various side pallet members and upper and lower pallet members of the pallet container of the invention are removably secured together, that is, by the complementary dovetail means on the various pallet members where their top and bottom side edges meet to form corners of the container. The entire assembly is secured or adapted to be secured, e.g., strapped or banded, together by suitable banding or strapping 18, clamped to itself by means of clamp 20, strap 18 being of steel, other suitable metal, or plastic such as Signode Dymax TM or the like. In some cases, however, such strapping or banding is not essential due to the strength of the dovetail juncture and/or the type of load to be transported in the container.

Lower pallet member 14, as well as top pallet member 14A and side panel or pallet members 16 are obviously extruded, openings or honeycombs 22 from the extrusion being visible in all members in this view. From this view, it is apparent that, which ever side may constitute the lowermost side of this pallet container, apertures will be available for the insertion of the prongs or tines of a forklift truck thereinto, both from the front and from the rear of the container.

Figure 2:
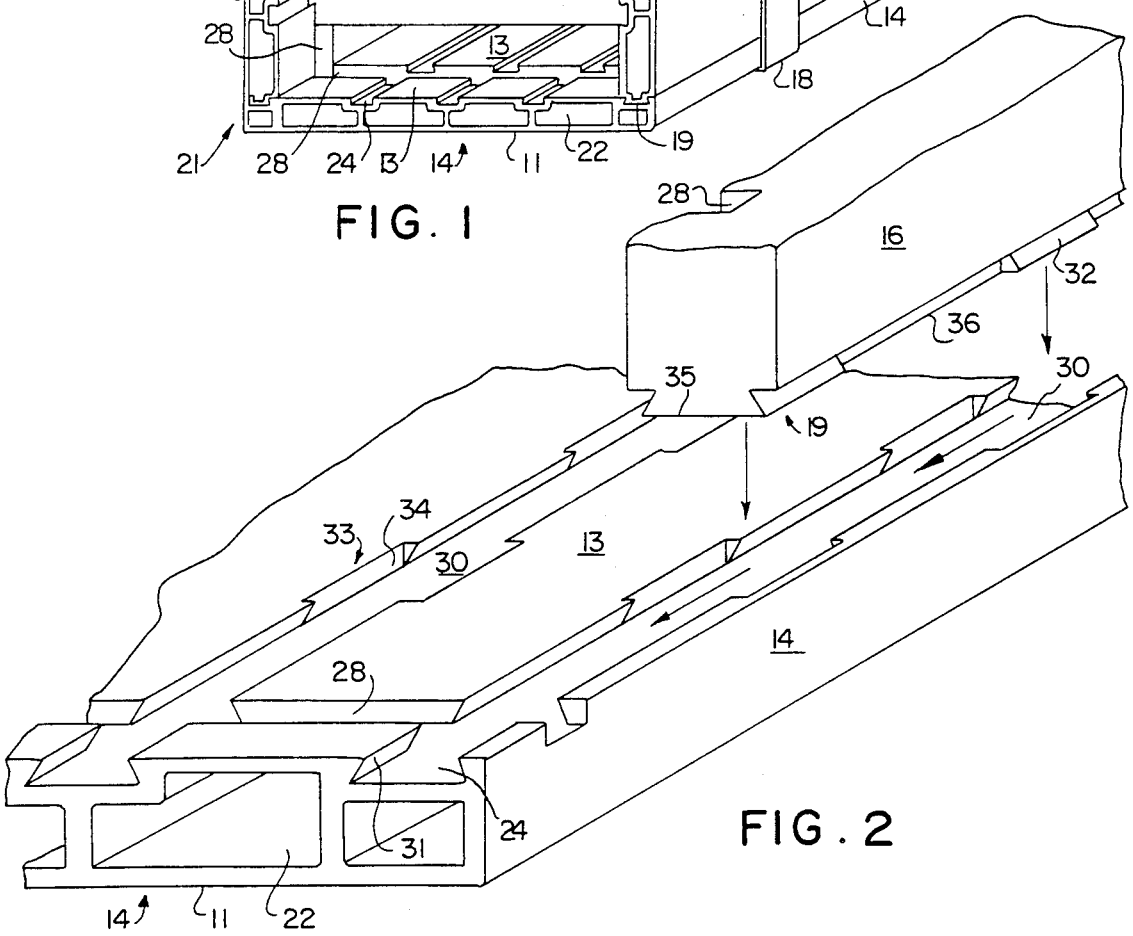
FIG. 2 is an enlarged partial isometric view of the bottom pallet and right side pallet (members) at their intersection, showing how they are assembled together at the right-hand corner of the container of FIG. 1.

The exterior surface of pallet member 14 is indicated as 11, the interior surface of pallet member 14 is indicated as 13, the interior surface of side wall members 16 is indicated as 15, and the exterior surface of side wall members 16 is indicated as 17, these surfaces being referenced for more ready understandability of the isometric of FIG. 2 showing how these members are assembled together.

Referring now to FIG. 2, the bottom 30 of female dovetail means or slot 24 is visible, along with sides 31 of female dovetail means or slot 24, and side segment 32 of male dovetail means or element 19. As shown at 33, notches are provided in side walls 31 of female dovetail element 24, at which point essentially perpendicular wall or surface 34 is presented, extending from inner surface 13 to bottom 30 of female dovetail means or slot 24, for purposes of receiving the side segments 32 of the male dovetail means 19 therein. A corresponding vertical wall 36 is provided in the male dovetail element 19, which terminates at lower flat surface 35 of the male dovetail element 19 for convenient connection of the side pallet member 16 with bottom pallet member 14 by insertion of the remaining integral side segments 32 of the male dovetail means 19 into female dovetail means 24 via notches 33 in wall 31 of female dovetail means 24 and then sliding the entire pallet member 16 along in female dovetail slot 24 until the unnotched side segments 32 of male dovetail means 19 are securely in contact with unnotched segments of wall 31 of female dovetail means 24, thereby releasably securing side pallet member 16 to bottom pallet member 14 by means of dovetail juncture, joint, or assembly 21 in the manner just explained.

Figure 3:
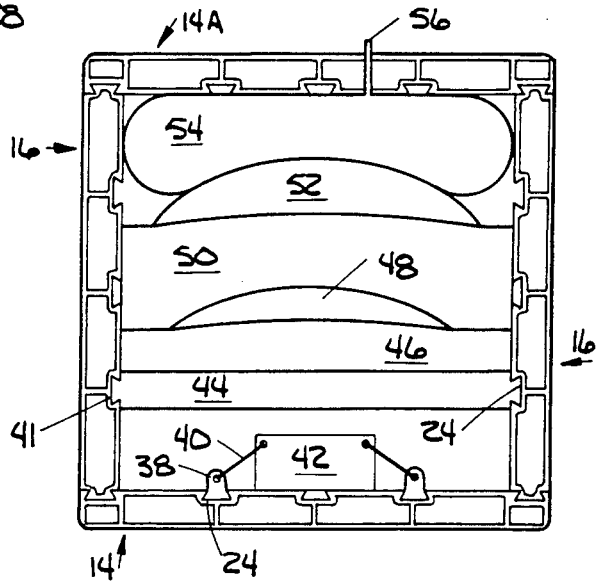
FIG. 3 is a front view of a pallet container of the invention showing how various tiedowns, removable dividers, and preformed packing panels may be employed therein for secure shipment of contents.

Referring now to FIG. 3, a load, e.g., comprising parts or workpieces or products 42, 43, and 52, is shown interior of a pallet container of the invention. Removable divider 44 is shown in place within the pallet container of the invention and removably secured to side walls 16 thereof by means of interlocking or mating engagement means comprising male dovetail 41, operating in conjunction with and releasably secured within complementary female dovetail 24. Preformed packing panel 46 rests upon horizontal divider or internal shipping or packing support 44. Formed packing panel 50, having an aperture designed to receive part 43, is in turn supported upon packing panel 46.

Part 52 in turn rests upon formed packing panel 50 and is securely held in place thereagainst by inflated air bag 54, having air filling stem 56 thereof protruding through an aperture in a wall of the container, as shown upper pallet member 14A, provided by drilling, tapping, or the like, for access from the exterior. On bottom pallet member 14 is secured part 42, attached by wire, cable, rope, or twine 40 to tiedowns 38, each having a male dovetail means which is releasably secured in female dovetail means 24 of bottom pallet member 14.

Figure 4:
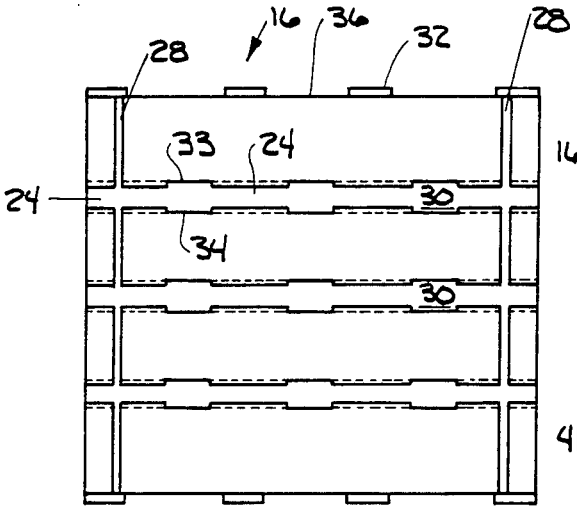
FIG. 4 is a face view of a side pallet member of the structure of FIG. 3 folded out showing the interior thereof.

In FIG. 4, which shows an inside view of pallet member 16 in folded-out position, notches 28 for end walls or vertical divider panels 10 are visible, as well as side 32 of male dovetail means 19 atop pallet member 16, with notches 36 therein, as well as the length of female dovetail means 24, with notches 33 and vertical surfaces 34 as well as the flat bottom 30 thereof all being plainly visible.

Figure 5:
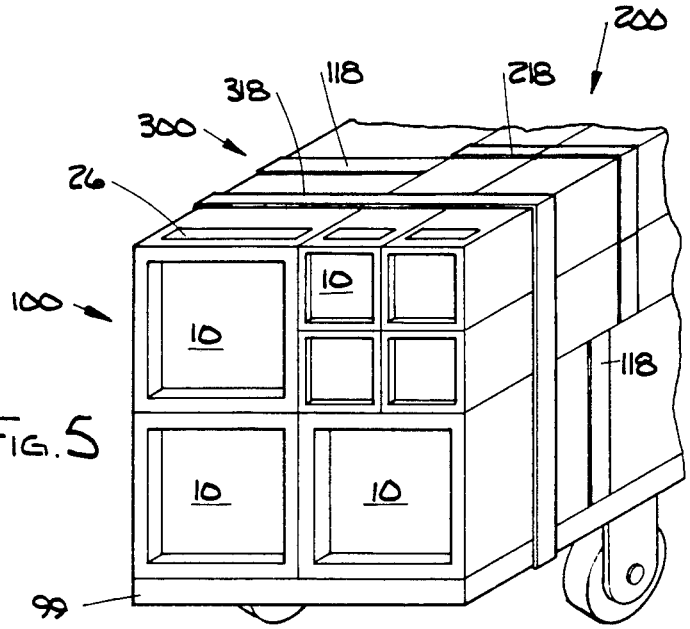
FIG. 5 is a schematic isometric view of an assembled multiple pallet container of the invention embodying several sizes of pallet containers and showing only some of the aspects of the invention.

In FIG. 5 is seen an assembly 300 of pallet containers of the invention, all banded together by means of suitable strapping 318 and assembled together on a cart 99. The fully-assembled larger pallet containers of the invention are shown at 100, whereas the assembled smaller pallet containers according to the invention are shown at 200, the strapping for the assembled smaller containers being indicated at 218 and the strapping for the assembled larger containers being indicated at 118, the entire assembly being indicated at 300 and secured with strap 318.

Figure 6:
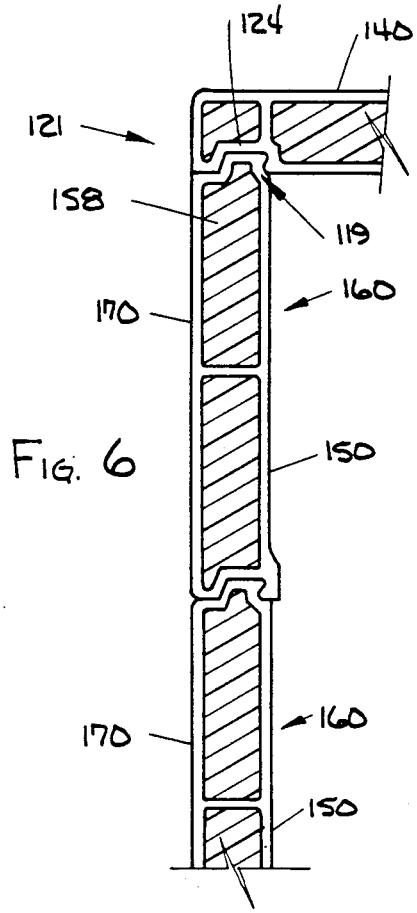
FIG. 6 is an end view partially in cross-section of a further embodiment of the pallet container of the invention showing side and top pallet members at their juncture and employing a universal dovetail connection for the separate panel sections.

In FIG. 6 is shown an end view, partially in cross-section, of another embodiment of the invention, side pallet member 160 and top pallet member 140 being illustrated, along with alternative and universal dovetail joint 121 comprising male dovetail means or element 119 and female dovetail means or element 124. Between exterior surface 170 of side pallet member 160 and interior surface 150 of side pallet member 160, in the honeycombed apertures left by the process of extrusion, since this is obviously an extruded pallet member, is located particulate, plastic, or foam filler 158. In this embodiment, the remaining side pallet member and the bottom pallet member are essentially identical except for absence of filler in those honeycombs in which the prongs of a forklift truck are to be received. It goes without saying that the interior surfaces of the various pallet members in this embodiment may be provided with female dovetails, or even male dovetails, for mating engagement and releasable or removable engagement and securement with oppositely-configured dovetail means on interior members, just as shown in previous FIGS. for other embodiments of the invention comprising somewhat differently shaped bottom pallet members and cooperating side and top pallet members. Moreover, as will be noticed, the alternate but universal dovetail joint assembly 121 as illustrated in FIG. 6 makes it possible to employ a multiplicity of identical pallet member sections, and to build up side walls or top and bottom walls of the container, since the dovetailing assembly 121 can be uniform throughout, allowing the employment of modular pallet member sections, for the production of a suitably-sized pallet member and/or pallet container having any desired wall size comprising any desired number of pallet members, as illustratively comprised by the plurality of pallet members 160 connected together by uniform or modular dovetail assemblies 121.

FIGS. 7, 8, and 11 illustrate a tiedown particularly suitable for use in connection with a pallet container of the invention, having a male dovetail means, as shown, these being the same as identified in FIG. 3 by the number 38, and having an aperture 37 therein for employment with rope, cable, wire, or the like for releasably securing an item to be shipped such as load 42 in FIG. 3. The tiedown shown in FIGS. 9, 10, and 12 is a longer tiedown and accordingly is provided not only with dovetail means 66 but also with notch 64, the longer tiedown being illustrated at 62, with aperture 39 for passage of a cable, rope, wire or the like therethrough.

In FIGS. 13 and 14 are illustrated in more detail the removable horizontal divider or internal support means 44 first shown in FIG. 3. From the top plan or face view shown in FIG. 13, male dovetail means 41 as first shown in FIG. 3 are visible, together with notches 43 for insertion into female dovetail means 24 as shown in FIGS. 2 and 3, the male dovetail elements 41 again being inserted in female dovetail element or slot 24 via notches 33 therein and then adjusted by sliding within female dovetail means 24 into a secure but readily slidably-releasable engagement with the walls 31 of the said female dovetail means 24.

Although the knockdown pallet container of the invention has been described primarily as having a rectangular configuration, it should be apparent to one skilled in the art that a pallet container of other than a rectangular configuration may also be employed. For example, the pallet container of the invention may take the shape of any suitable polygon, such as a triangle, especially an equilateral, isosceles, or right triangle, or any other suitable parallelogram or rectangle, such as a pentagon or hexagon, among which a rectangular configuration and especially a square configuration is preferred for greatest stability. The only limiting factor is that the pallet container of the invention must have a bottom-forming pallet member and a sufficient number of side pallet members, with or without a top pallet member, to complete the polygonal configuration. Although a rectangular configuration and particularly a square configuration is highly advantageous from the standpoint of innate stability, it will immediately be apparent to one skilled in the art that a triangular configuration can be employed with only somewhat lesser facility and with only somewhat lesser stability, and that other polygonal configurations may also be utilized, especially when appropriate stabilizing internal dividers or internal supports are provided therein, and preferably also when additional support is provided at the corners of the container, and that in certain instances a triangular configuration may be preferred, such as for the shipping of extremely elongated articles or the like. Nevertheless, a polygonal configuration with a maximum of four (4) sides is preferred in any event for maximum stability, simplicity, and facility of construction and erection. Accordingly, it should be apparent that the invention does not relate only to pallet containers of rectangular configuration, but that other suitable polygonal configurations may also be employed, as just enumerated in the foregoing.

From the foregoing, it is seen that the pallet container of the invention, in its various and variable embodiments and adaptations, is conveniently versatile and adaptable to the shipment of innumerable objects with equal facility, and that the precise interior and even exterior structure of a pallet container of the invention can be varied at will to suit the needs of even the most demanding and discriminating shippers.

It is accordingly seen from the foregoing that the present invention provides a highly desirable and advantageous pallet container or shipping container embodying pallet features, which comprises a bottom load-supporting pallet member and side walls, together constituting a pallet container, and if desired end caps, walls, or plates, which is suitable for the shipment of innumerable types of materials and products therein and, at the same time, a unique load-supporting pallet which may be separated from the other pallet container members which may be knocked-down for return to the place of origin, while the basic or bottom-forming or load-supporting pallet member may either accompany them back to the point of origin or continue to serve as a load-supporting pallet for the continued support of whatever load, material, or product was originally shipped thereon, all having the foregoing characteristics and advantages as previously enumerated.

It is to be understood that the present invention is not to be limited to the exact materials, structures, procedures, or arrangements disclosed, as numerous modifications and changes therein will immediately become apparent to one skilled in the art to which this invention pertains, wherefore the present invention is to be understood as limited only by the full scope which can be legally accorded to the appended claims.

I claim:

1. A knockdown pallet container formed of extruded pallet members, comprising a bottom-forming pallet member, a top pallet member, and side pallet members, a combination of the bottom, side and top pallet members providing a pallet container of rectangular configuration, at least the top and bottom-forming pallet members being honeycombed so as to provide entryways in the extruded member for insertion of the prongs of a lift truck thereinto, the rectangular pallet container being adapted to be banded together if necessary or desirable by external strapping which holds complementary dovetail means at sides of the various pallet members in mating engagement with each other where they meet to form corners of said container, comprising also entryways for the entry of forklift prongs in at least one of the side pallet members, thereby to permit entry of prongs of a forklift whether the pallet container is resting upon one member or another.

2. A pallet container of claim 1, wherein the sides of the pallet members are configured so as to provide complementary male and female dovetail means for mating engagement of the sides of the panel members with each other.

3. A pallet container of claim 1, wherein the sides of the pallet members are configured so as to provide male and female interlocking dovetails.

4. A pallet container of claim 1, wherein at least the bottom-forming pallet member has entryways for the prongs of a lift truck at both its front and rear.

5. A pallet container of claim 1, wherein internal support means are provided for supporting a load interior of said pallet container.

6. A pallet container of claim 5, wherein the internal support means are provided with dovetail means adapted to mate with complementary dovetail means provided on pallet members interior of the pallet container for mating engagement of the dovetail means on the internal support means and pallet members.

7. A pallet container of claim 6, wherein the dovetail means comprise a male dovetail on the internal support means and a female dovetail on a surface of a pallet member interior of the container.

8. A pallet container of claim 1, comprising end wall means for closing an end of the container.

9. A pallet container of claim 8, comprising also securing means for securing said end wall means with respect to a pallet member of said container.

10. A pallet container of claim 9, wherein said securing means comprises a slot in a pallet member of said container adapted to receive said wall means.

11. A pallet container of claim 10, comprising also a through-slot in a pallet member for insertion of said wall means into said container through said member.

12. A pallet container of claim 11, wherein said pallet member comprising said through-slot is a top member.

13. A pallet container of claim 11, wherein said wall means comprises finger-grip means to assist with insertion and removal thereof.

14. A pallet container of claim 8, comprising end walls at both the front and rear thereof.

15. A pallet container of claim 14, wherein said end walls are received in slots in three pallet members and inserted into said container via a through-slot provided in the remaining pallet member.

16. A pallet container of claim 1, comprising also internal support means adapted to support or protect a load being transported therein.

17. A pallet container of claim 1, wherein entryways for the entry of prongs of a forklift are provided in all four of the bottom, top, and side pallet members, thereby to allow entry of prongs of a forklift regardless of the member upon which said pallet container is resting.

18. A pallet container of claim 17, comprising entryways for the insertion of prongs of a forklift therein in all of the pallet members at both their front and at their rear.

19. A pallet container of claim 18, wherein all of said pallet members are honeycombed and wherein said entryways are provided in the form of apertures into the pallet members themselves.

20. A pallet container of claim 16, comprising removable interlocking internal support means for support or protection of a load being shipped.

21. A pallet container of claim 20, wherein said internal support means internal comprises engagement means on interior walls of the pallet members, adapted to receive complementary engagement means of tiedowns, dividers, shelves, and trays.

22. A pallet container of claim 21, wherein interior walls of pallet members are provided with female dovetail elements and the complementary engagement means comprises male dovetail elements for mating engagement therewith.

23. A pallet container of claim 20, wherein said internal support means comprises at least one of tiedown means, for tying an article wall-to-wall horizontal divider means for dividing a load support and means adapted to the shape of the load being shipped.

24. A pallet container of claim 16, wherein said internal support means comprises a bladder or airbag having filling means for filling said bladder or airbag and wherein an adjacent wall of said container comprises an aperture for said filling means whereby it is accessible from outside the container.

25. A pallet container of claim 1, wherein the top and bottom pallet members have identical side dovetail means and the side pallet members have identical dovetail means for mating engagement of the sides of said panel members with each other, thereby to provide a mating dovetail joint at the container corners.

26. A pallet container of claim 1, wherein the bottom, top, and side pallet members of the pallet container have identical dovetail means at the sides thereof much abut at the corners of the container, so as to provide identical dovetail joints at the corners of the container.

27. A pallet container of claim 25, there being only two types of dovetail means, which means are identical at both sides of the same pallet member.

28. A pallet container of claim 26, wherein the dovetail means is the same for all pallet members at both sides thereof.

29. A pallet container of claim 1, wherein the container is formed from a plurality of identical pallet sections.

30. A pallet container of claim 1, wherein mating dovetail elements are provided with notches in female and male elements thereof, so as to permit ready insertion of one dovetail element into another and securement of the dovetail joint by sliding a male dovetail element to a position of mating engagement with walls of a female dovetail element.

31. A pallet container of claim 16, wherein interior walls of pallet members are provided with dovetail elements and interior support means is provided with complementary dovetail elements for mating engagement therewith.

32. A pallet container of claim 31, wherein internal support members are provided with male dovetail elements and interior walls of pallet members are provided with female dovetail elements for mating engagement therewith.

33. A pallet container of claim 32, wherein said male and female dovetail elements are provided with notches for ready insertion of male dovetail elements into female dovetail elements and for slidable adjustment into secured mating engagement therewith.

34. A pallet container of claim 28, wherein a pallet member is formed from a plurality of identical sections.

35. A knockdown pallet container formed of extruded pallet members, comprising a bottom-forming pallet member and additional pallet members, a combination of the bottom, and additional pallet members providing a pallet container of polygonal configuration, all said pallet members being honeycombed so as to provide entryways in the extruded members for insertion of the prongs of a lift truck thereinto, the polygonal pallet container being adapted to be banded together if necessary or desirable by strapping which holds complementary dovetail means at sides of the various pallet or panel members in mating engagement with each other where they meet to form corners of said container, the entrywaays for the entry of forklift prongs in the pallet members, permitting entry of prongs of a forklift whether the pallet container is resting upon one member or another.

36. A pallet container of claim 35, wherein the sides of the pallet members are configured so as to provide complementary male and female dovetail means for mating engagement of the sides of pallet members with each other.

37. A pallet container of claim 36, wherein the polygonal container has the configuration of a polygon having a maximum of four sides.

38. A pallet container of claim 37, wherein more than one pallet member is honeycombed and has entryways for the prongs of a lift truck at both ends thereof.

39. A pallet container of claim 37, wherein all of said pallet members are honeycombed and all have entryways for the prongs of a lift truck at both ends thereof.

40. A pallet container of claim 37 comprising at least one end wall mounted in slots or recesses in a plurality of the said pallet members for support of the wall.

41. A pallet container of claim 37 comprising at least one divider mounted in slots or recesses in a plurality of the said pallet members for support of the divider.

42. A plurality of rectangular pallet members adapted to produce, with additional pallet members, a pallet container each pallet member, having dovetail means at two sides thereof adapted for mating engagement with complementary dovetail mating engagement means at a side of two other of said pallet members to form a joint at the corners of a rectangular pallet container formed therefrom, all of said pallet members having entryways for the prongs of a forklift truck.

43. A plurality of rectangular pallet members adapted to produce, additional pallet members, a pallet container each pallet member, having dovetail means at two sides thereof adapted for mating engagement with complementary dovetail mating engagement means at a side of two other of said pallet members to form a joint at the corners of a polygonal pallet container formed therefrom, all of said pallet members having entryways for the prongs of a forklift truck.

44. Pallet members of claim 42, wherein the dovetail mating engagement means at one side of each pallet member has a female dovetail configuration and the dovetail mating engagement means at the other side of the pallet member has a male dovetail configuration.

45. The pallet members of claim 42, wherein the dovetail mating engagement means at both sides of each pallet member has the same dovetail configuration.

46. Pallet members of claim 43, wherein the dovetail mating engagement means at one side of the pallet member has a female dovetail configuration and the means at the other side of the pallet member has a male dovetail configuration.

47. The pallet members of claim 43, wherein the dovetail mating engagement means at both sides of each pallet member has the same dovetail configuration.

48. A pallet container of claim 1 which is banded together by external strapping.

49. A pallet container of claim 35 which is banded together by external strapping.

50. A knockdown pallet container formed of extruded pallet members, comprising a bottom-forming pallet member, a top pallet member, and side pallet members, a combination of the bottom, side, and top pallet members providing a pallet container of rectangular configuration, at least the side, top, and bottom-forming pallet members being honeycombed so as to provide entryways in the extruded members for insertion of the prongs of a lift truck thereinto, the rectangular pallet container being adapted to be banded together if necessary or desirable by external strapping which holds complementary dovetail means at sides of the various pallet members in mating engagement with each other where they meet to form corners of said container, said complementary dovetail means at the sides of the various pallet members being in mating engagement with each other where they meet to form corners of said container along the entire length of the sides of the pallet members where they meet to form the four side corners of the rectangular container and being adapted to form a continuous mated engagement joint along the four side corners of the rectangular pallet container formed thereform.

51. A knockdown pallet container of claim 50 wherein the said complementary dovetail means are adapted to be slid into mated engagement with each other.

52. A knockdown pallet container formed of extruded pallet members, comprising a bottom-forming pallet member and additional pallet members, a combination of the bottom and additional pallet members providing a pallet container of polygonal configuration, all said pallet members being honeycombed so as to provide entryways in the extruded members for insertion of the prongs of a lift truck thereinto, the polygonal pallet container being adapted to be banded togther if necessary or desirable by external strapping which holds complementary dovetail mating engagement means at sides of the various pallet members in mating engagement with each other where they meet to form corners of said container, said complementary dovetal mating engagement means at the sides of the various pallet members being in mating engagement with each other where they meet to form corners of said container only the entire length of the sides of the pallet members where they meet to form the corners of the polygonal container and being adapted to form a continuous mated engagement joint along the corners of the polygonal pallet container formed therefrom.

53. A knockdown pallet container of claim 52 wherein the said complementary dovetail mating engagement means are adapted to be slid into mated engagement with each other.

54. A plurality of rectangular pallet members adapted to produce a pallet container each pallet member, having dovetail means along the full length of two sides thereof adapted for mating engagement with complementary dovetail means along the full length of a side of two other of said pallet members to form a joint at the corners of a rectangular pallet container formed therefrom, said complementary dovetail means at said two sides of each pallet member being continuous whereby said pallet members are adapted to form a continuous mated engagement joint along the four side corners of a rectangular pallet container produced therefrom, all of said pallet members having entryways for the prongs of a forklift truck.

55. The pallet members of claim 54, wherein the said complementary dovetail mating engagement means on each pallet member are adapted to be slid into mated engagement with complementary dovetail mating engagement means on another pallet member.

56. A plurality of rectangular pallet members adapted to produce a pallet container each pallet member having dovetail means along the full length of two sides thereof adapted for mating engagement with complementary dovetail means along the full length of a side oof two other of said pallet members to form a joint at the corners of a polygonal pallet container formed therefrom, said complementary dovetail means at said two sides of each pallet member being continuous whereby said pallet members are adapted to form a continuous mated engagement joint along the corners of a polygonal pallet container produced thereform, all of said pallet members having entryways for the prongs of a forklift truck.

57. The pallet member of claim 56 wherein the said complementary dovetail mating engagement means on each pallet member are adapted to be slid into mated engagement with complementary dovetail mating engagement means on another pallet member.

58. A pallet container of claim 1, comprising divider means for dividing the container into compartments.

59. A pallet container of claim 58, comprising also securing means for securing said divider means with respect to a pallet member of said container.

60. A pallet container of claim 59, wherein said securing means comprises a slot in a pallet member of said container adapted to receive said divider means.

61. A pallet container of claim 59, comprising also a through-slot in a pallet member for insertion of said divider means into said container through said member.

62. A pallet container of claim 61, wherein said pallet member comprising said through-slot is a top member.

63. A pallet container of claim 61, wherein said divider means comprises finger-grip means to assist with insertion and removal thereof.

* * * * *

UNITED STATES PATENT AND TRADEMARK OFFICE

CERTIFICATE OF CORRECTION

PATENT NO. : 5,058,746

DATED : Oct. 22, 1991

INVENTOR(S) : Robert L. Morgan, IV

It is certified that error appears in the above-identified patent and that said Letters Patent is hereby corrected as shown below:

Column 3, line 59; "knowdown" should read -- knockdown --.

Column 5, approximately line 42; "a p pallet" should read, delete "p" and begin a new paragraph with "pallet".

Column 11, line 12; "compries" should read -- comprises --.

Column 12, line 57; "internal comprises" should read -- comprises internal --.

Column 13, line 65; "pallet or panel members" should read -- pallet members--.

Column 13, line 68; "trywaays" should read -- tryways --

Column 14, line 34; "produce, additional" should read -- produce, with additional --

Column 14, line 42; "Pallet" should read -- The pallet --.

Column 14, line 46; "the pallet" should read -- each pallet --.

Column 14, line 50; "Pallet" should read -- The pallet --.

Column 14, line 51; "the" should read -- each --.

Column 14, line 52; "the means" should read -- the dovetail mating engagement means --.

Column 14, line 53; "of the pallet" should read -- of each pallet-

Column 15, line 34; "togther" should read -- together --.

Column 15, line 39; "dovetal" should read -- dovetail --.

UNITED STATES PATENT AND TRADEMARK OFFICE

CERTIFICATE OF CORRECTION

PATENT NO. : 5,058,746

DATED : Oct. 22, 1991

INVENTOR(S) : Robert L. Morgan, IV

It is certified that error appears in the above-identified patent and that said Letters Patent is hereby corrected as shown below:

Column 15, line 43; "only" should read -- along --.

Column 16, approximately line 24; "oof" should read -- of --.

Column 16, line 33; "member" should read -- members --.

Signed and Sealed this

Twentieth Day of April, 1993

*Attest:*

MICHAEL K. KIRK

*Attesting Officer*

*Acting Commissioner of Patents and Trademarks*